US009946220B2

(12) United States Patent
Watanabe et al.

(10) Patent No.: US 9,946,220 B2
(45) Date of Patent: Apr. 17, 2018

(54) DEVELOPER CARTRIDGE HAVING GEAR WITH PROTRUDING PART IN WHICH MOVEMENT OF PROTRUDING PART CAN BE DELAYED

(71) Applicant: Brother Kogyo Kabushiki Kaisha, Nagoya-shi, Aichi-ken (JP)

(72) Inventors: Tomonori Watanabe, Ichinomiya (JP); Naoya Kamimura, Ichinomiya (JP); Takashi Shimizu, Nagoya (JP); Hideshi Nishiyama, Owariasahi (JP); Keita Shimizu, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/282,261

(22) Filed: Sep. 30, 2016

(65) Prior Publication Data

US 2017/0097607 A1 Apr. 6, 2017

(30) Foreign Application Priority Data

Oct. 2, 2015 (JP) ..... 2015-197201

(51) Int. Cl.
*G03G 15/04* (2006.01)
*G03G 21/16* (2006.01)

(52) U.S. Cl.
CPC ..... *G03G 21/1676* (2013.01); *G03G 21/1647* (2013.01); *G03G 2221/1657* (2013.01)

(58) Field of Classification Search
USPC ..... 399/107, 110, 111, 119, 120, 167, 252, 399/258, 262, 263
See application file for complete search history.

(56) References Cited

U.S. PATENT DOCUMENTS 7,826,773 B2 * 11/2010 Kawamura ..... G03G 15/0121 399/228
8,676,064 B2 3/2014 Takagi
8,862,027 B2 * 10/2014 Fujii ..... G03G 21/1821 399/119
9,104,172 B2 8/2015 Takagi
9,256,195 B2 * 2/2016 Shimizu ..... G03G 15/0865
9,323,214 B2 * 4/2016 Itabashi ..... G03G 21/1821
9,405,266 B2 8/2016 Takagi
(Continued)

FOREIGN PATENT DOCUMENTS

JP 5556291 B2 7/2014

*Primary Examiner* — Hoan Tran
(74) *Attorney, Agent, or Firm* — Banner & Witcoff, Ltd.

(57) ABSTRACT

A developer cartridge includes a first gear having a first engagement part provided along a circumferential surface of the first gear, and a first trigger protruding from the circumferential surface. The developer cartridge also has a second gear having a small diameter gear part configured to be engaged to the first engagement part, a large diameter gear part rotatable together with the small diameter gear part, and a second trigger configured to contact and rotate the first gear. The large diameter gear part is configured to receive a driving force and rotate to move from a first position at which the large diameter gear part can rotate relative to the second trigger to a second position at which the large diameter gear part rotates together with the second trigger. The second trigger is configured to rotate together with the large diameter gear part to contact the first trigger.

20 Claims, 16 Drawing Sheets

(56) References Cited

U.S. PATENT DOCUMENTS

| | | | |
|---|---|---|---|
| 2011/0236066 | A1 | 9/2011 | Takagi |
| 2014/0241756 | A1 | 8/2014 | Takagi |
| 2015/0301478 | A1 | 10/2015 | Takagi |

* cited by examiner

DEVELOPER CARTRIDGE HAVING GEAR WITH PROTRUDING PART IN WHICH MOVEMENT OF PROTRUDING PART CAN BE DELAYED

CROSS-REFERENCE TO RELATED APPLICATIONS

This application claims priority from Japanese Patent Application No. 2015-197201 filed on Oct. 2, 2015, the entire contents of which are incorporated herein by reference.

TECHNICAL FIELD

The disclosure relates to a developer cartridge configured to accommodate therein developer.

BACKGROUND

In the related art, a developer cartridge has been known which has a detection protrusion configured to be engaged with an actuator provided to a main body housing of an image forming apparatus. Specifically, according to this technology, when the developer cartridge is mounted, the detection protrusion presses the actuator. Thereafter, when a driving force is input to the developer cartridge, the detection protrusion soon starts to move and retreats from the actuator.

In the meantime, the detection protrusion is used for enabling a control device to recognize a brand-new state, a specification and the like of the developer cartridge. Therefore, in some cases, it is required to delay a timing at which the detection protrusion starts to move by a predetermined time from an input of the driving force.

SUMMARY

The disclosure provides a developer cartridge capable of delaying a timing at which a detection protrusion starts to move.

According to an aspect of the disclosure, there is provided a developer cartridge including: a first gear rotatable about a first axis extending in an axis direction, the first gear having: a protruding part rotatable together with the first gear and protruding in the axis direction; a first engagement part provided along a part of a circumferential surface of the first gear and formed along a rotating direction of the first gear; and a first trigger protruding from the circumferential surface of the first gear and located with being spaced from the first engagement part in the rotating direction; and a second gear rotatable about a second axis extending in the axis direction, the second gear having: a small diameter gear part configured to be engaged to the first engagement part; a large diameter gear part having a diameter larger than a diameter of the small diameter gear part and rotatable together with the small diameter gear part; and a second trigger configured to contact the first trigger and to rotate the first gear by rotating about the second axis, wherein the large diameter gear part is configured to receive a driving force and rotate to thus move from a first position at which the large diameter gear part can rotate relative to the second trigger to a second position at which the large diameter gear part rotates together with the second trigger, and wherein the second trigger is configured to rotate together with the large diameter gear part to thus contact the first trigger.

According to another aspect of the disclosure, there is provided a developer cartridge including: a first gear rotatable about a first axis extending in an axis direction, the first gear having: a protruding part rotatable together with the first gear and protruding in the axis direction; a first engagement part provided along a part of a circumferential surface of the first gear and formed along a rotating direction of the first gear; and a first trigger protruding from the circumferential surface of the first gear and located with being spaced from the first engagement part in the rotating direction; and a second gear rotatable about a second axis extending in the axis direction and having an opening formed along a rotating direction, the second gear having: a small diameter gear part configured to be engaged to the first engagement part; a large diameter gear part having a diameter larger than the small diameter gear part and rotatable together with the small diameter gear part; a second trigger configured to be engaged to the first trigger and to rotate the first gear by rotating about the second axis; and a contact part positioned in the opening and configured to rotate together with the second trigger, wherein an edge forming the opening has a first end portion in the rotating direction of the second gear and a second end portion opposite to the first end portion, and wherein the large diameter gear part is configured to rotate from a first position at which the first end portion and the contact part are spaced in the rotating direction and the large diameter part can rotate relative to the second trigger to a second position at which the first end portion and the contact part are contacted to each other due to the rotation of the large diameter gear part and the large diameter part rotates together with the second trigger.

According to the respective configurations, when the driving force is input to the large diameter gear part, the large diameter gear part is moved from the first position at which it can rotate relative to the second trigger to the second position at which it rotates together with the second trigger. For this reason, a timing at which the second trigger starts to move is delayed from the input of the driving force to the large diameter gear part. Therefore, it is possible to delay a timing at which the second trigger and the first trigger becomes engaged and a timing at which the protruding part starts to move.

Accordingly, it is possible to delay the timing at which the detection protrusion (protruding part) starts to move.

DETAILED DESCRIPTION

Figure 1A:
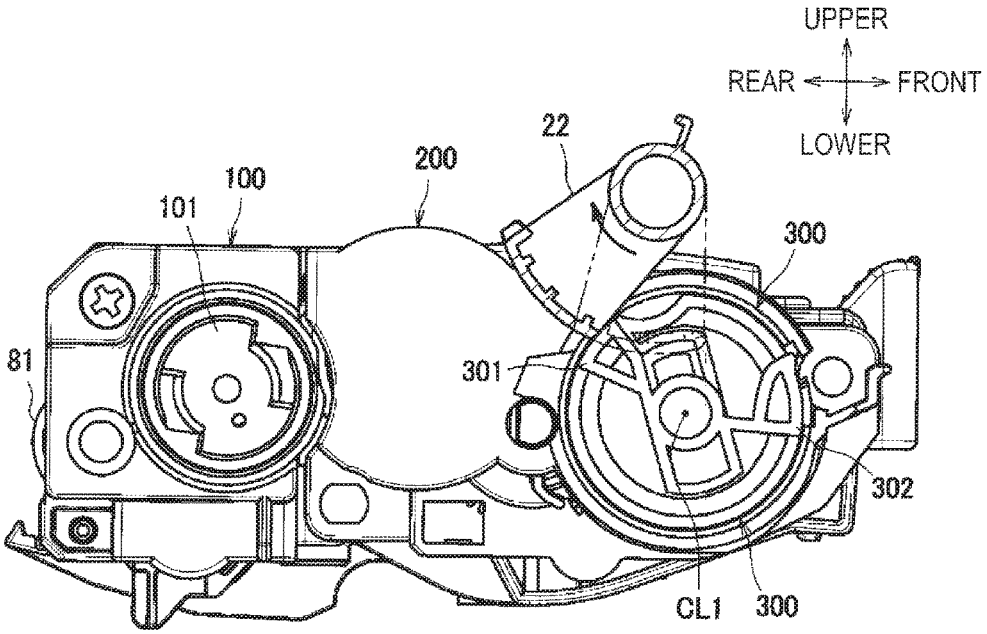
FIG. 1A is a side view depicting a developing cartridge in accordance with a first illustrative embodiment, and FIG. 1B schematically depicts a gear mechanism provided to the developing cartridge.

Hereinafter, a structure of a developing cartridge 8, which is an example of the developer cartridge in accordance with a first illustrative embodiment of the disclosure, will be described in detail. In the following descriptions, directions are described based on directions shown in FIG. 1. That is, a right side of FIG. 1 is referred to as 'front side', a left side is referred to as 'rear side', an inner side of a direction perpendicular to the drawing sheet is referred to as 'right side' and a front side of the direction perpendicular to the drawing sheet is referred to as 'left side.' Also, the upper-lower direction in FIG. 1 is referred to as 'upper-lower direction,' as it is.

As shown in FIG. 1A, the developing cartridge 8 has a developing roller 81 extending in an axis direction, a cartridge main body 100, which is an example of the housing, a gear cover 200, and a first detection protrusion 301 (an example of the first protruding part) and a second detection protrusion 302 (an example of the second protruding part) which are exposed outside the gear cover 200. The first detection protrusion 301 and the second detection protrusion 302 are provided to a detection gear 300 configured to rotate about a first axis CL1 and are disposed at an interval in a rotating direction of the detection gear 300. Meanwhile, in the cartridge main body 100, a toner accommodation unit configured to accommodate therein toner, which is an example of the developer, an agitator configured to stir the toner in the toner accommodation unit, a supply roller configured to supply the toner to the developing roller 81, and the like are provided.

Figure 1B:
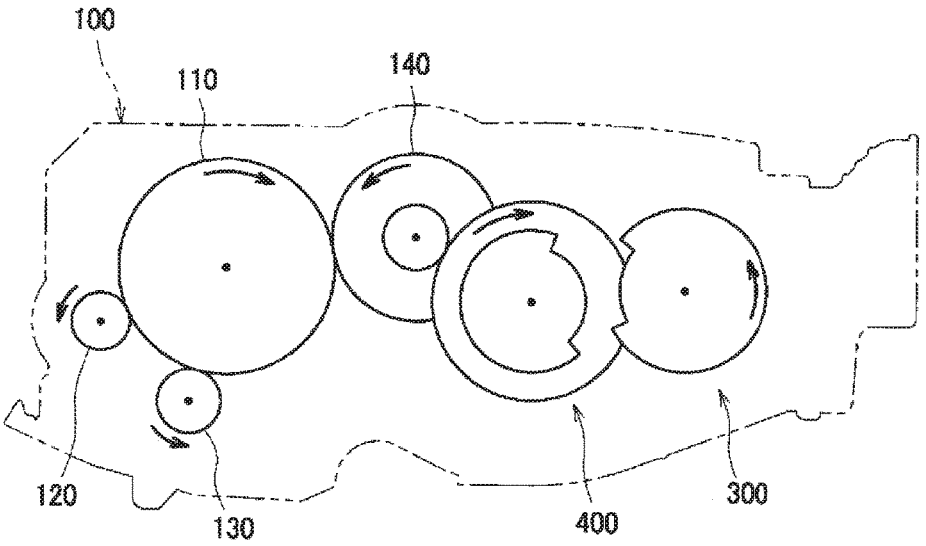

As shown in FIG. 1B, an input gear 110, a developing roller driving gear 120, a supply roller driving gear 130, an idle gear 140, the detection gear 300, which is an example of the first gear, and a transmission gear 400, which is an example of the second gear, are rotatably provided on an outer surface in a left-right direction of the cartridge main body 100. In FIG. 1B, each gear is simplistically shown.

The input gear 110 is provided coaxially and integrally with an input coupling 101 (refer to FIG. 1A) to which a driving force is to be input from a motor (not shown) provided to a main body of an image forming apparatus, and is configured to be rotatable integrally with the input coupling 101. The developing roller driving gear 120 is supported by a rotating shaft of the developing roller 81, is configured to be rotatable integrally with the developing roller 81, and is meshed with the input gear 110.

The supply roller driving gear 130 is supported by a rotating shaft of the supply roller, is configured to be rotatable integrally with the supply roller, and is meshed with the input gear 110. The idle gear 140 is meshed with the input gear 110 and the transmission gear 400.

The transmission gear 400 is a gear configured to rotate by a driving force received from the idle gear 140 and is configured to intermittently transmit the driving force to the detection gear 300. The detection gear 300 is a gear configured to rotate only while the driving force is being received from the transmission gear 400, and is configured so that at an initial state, the first detection protrusion 301 is located at a detection position, and when the driving force is received from the transmission gear 400, the second detection protrusion 302 moves toward the detection position, becomes located at the detection position, and then stops. In other words, the detection gear 300 is arranged at a third position at the initial state and is arranged at a fifth position at a final state. When the detection gear 300 is located at the third position, the first detection protrusion 301 contacts an actuator 22 (which will be described later), and when the detection gear 300 is located at the fifth position, the second detection protrusion 302 contacts the actuator 22.

Figure 2:
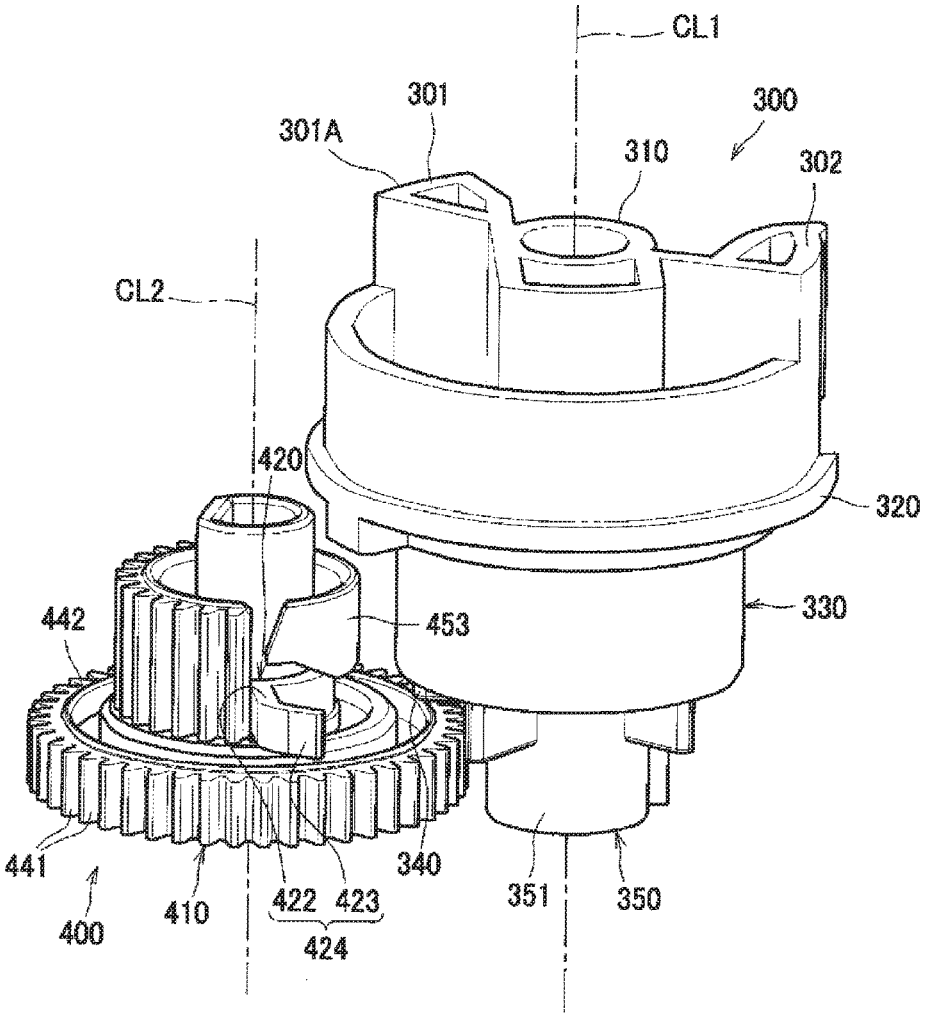
FIG. 2 is a perspective view depicting a transmission gear and a detection gear.

Specifically, as shown in FIG. 2, the detection gear 300 is a gear configured to be rotatable about the first axis CL1 in the axis direction, and integrally has the first detection protrusion 301, the second detection protrusion 302, a rotating shaft part 310, a flange part 320, which is an example of the circular plate part, a first missing tooth gear part 330, a first trigger 340, and a second missing tooth gear part 350. The rotating shaft part 310 has a cylinder shape centered on the first axis CL1, and is configured to be rotatable relative to the cartridge main body 100. The flange part 320, the first missing tooth gear part 330, the first trigger 340 and the second missing tooth gear part 350 are arranged side by side in corresponding order from an upper side of FIG. 2 (an outer side in a rotating axis direction) toward a lower side of FIG. 2 (an inner side of the rotating axis direction).

The flange part 320 is a circular plate-shaped part extending from a substantially center in the rotating axis direction of the rotating shaft part 310 toward a radially outer side, and the first detection protrusion 301 and the second detection protrusion 302 are formed to protrude from an upper end surface of the flange part in FIG. 2 (an opposite surface to a surface of the cartridge main body 100-side) toward an upper side in FIG. 2 (the axis direction). The first detection protrusion 301 and the second detection protrusion 302 are arranged at positions on the flange part 320 deviating from the first axis CL1 in a direction perpendicular to the axis direction, and protrude in the axis direction.

Figure 4A:
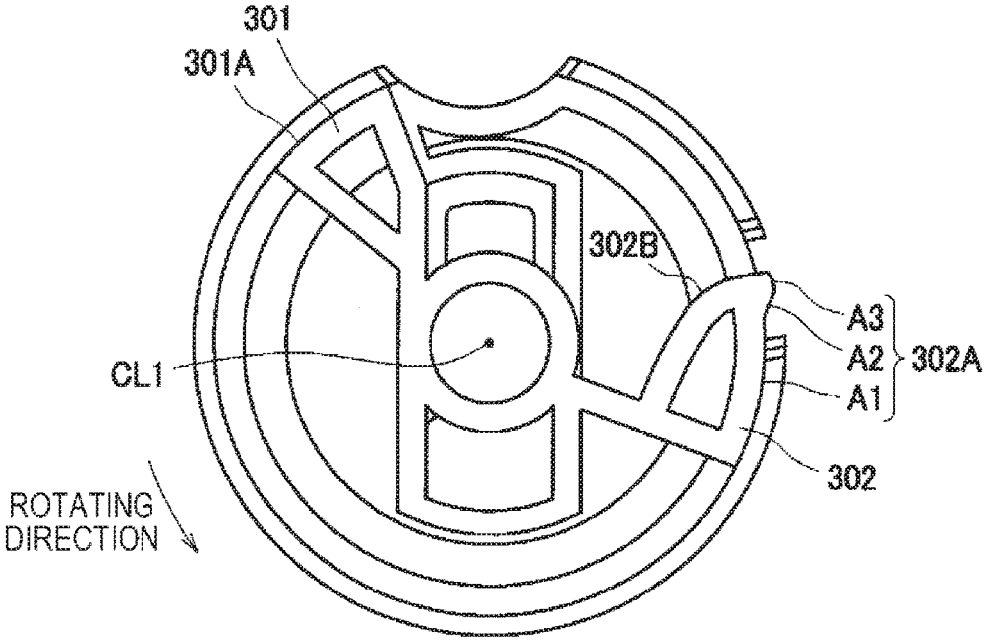
FIG. 4A depicts each detection protrusion of a standard type.

As shown in FIG. 4A, the second detection protrusion 302 has a first surface 302A extending substantially in the rotating direction and a second surface 302B extending from a downstream end portion (an end portion close to the first detection protrusion 301) of the first surface 302A with respect to the rotating direction toward the first axis CL1. Specifically, the first surface 302A has a surface A1 extending along the rotating direction, a surface A2 extending from a downstream end portion of the surface A1 with respect to the rotating direction toward an outer side in the radial direction and toward a downstream side with respect to the rotating direction, and a surface A3 extending from the surface A2 toward a downstream side with respect to the rotating direction. The second surface 302B extends from a downstream end portion of the surface A3 with respect to the rotating direction toward an inner side in the radial direction and toward an upstream side with respect to the rotating direction. That is, the second surface 302B extends to be curved toward the first axis CL1.

Figure 3A:
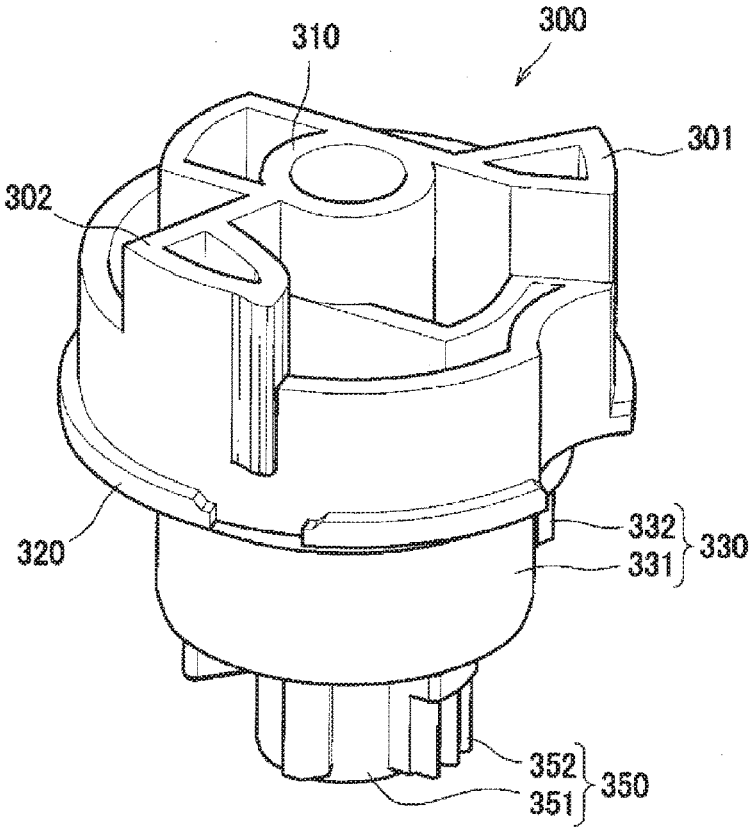
FIG. 3A is a perspective view depicting the detection gear.
Figure 3B:
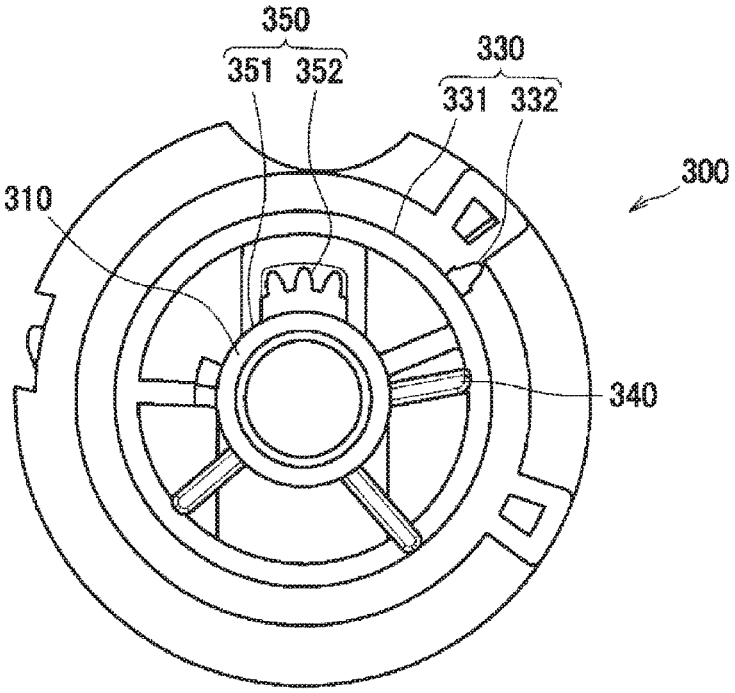
FIG. 3B depicts the detection gear as seen from a second missing tooth gear part-side.

As shown in FIGS. 3A and 3B, the first missing tooth gear part 330 has a first missing tooth part 331 of which a circumferential surface has a substantially cylinder shape, and one first gear tooth part 332 (an example of the first engagement part) disposed at the same position as the first missing tooth part 331 in the rotating axis direction and protruding radially outward from the first missing tooth part 331. The first gear tooth part 332 is provided along a part of the circumferential surface of the detection gear 300 and is formed along the rotating direction.

As shown in FIG. 3B, the first trigger 340 is formed to have a plate shape protruding radially outward from a circumferential surface of the rotating shaft part 310 and intersecting with the rotating direction. The first trigger 340 is disposed at a position spaced from the first gear tooth part 332 in the rotating direction. A tip portion of an outer side in the radial direction of the first trigger 340 is disposed at a more inner side in the radial direction than a circumferential surface of the first missing tooth part 331.

A diameter of the second missing tooth gear part 350 is smaller than a diameter of the first missing tooth gear part 330. The second missing tooth gear part 350 has a second missing tooth part 351 having a circumferential surface having a substantially cylinder shape, i.e., a circumferential surface not formed with a gear tooth, and a plurality of second gear tooth parts 352 disposed at the same position as the second missing tooth part 351 in the rotating axis direction and protruding radially outward from the second missing tooth part 351. In the meantime, a diameter of the second gear tooth part 352 is defined as a tooth tip circle thereof. The second gear tooth part 352 is an example of the second engagement part.

As shown in FIG. 2, the transmission gear 400 is a gear configured to be rotatable about a second axis CL2 extending in the axis direction, and is disposed in the vicinity of an upstream side of the detection gear 300 with respect to a transmission direction of the driving force. The transmission gear 400 has a first member 410 configured to be rotatable relative to the cartridge main body 100 and a second member 420 disposed coaxially with the first member 410 and configured to be rotatable relative to the first member 410. The first member 410 is supported by a rotating shaft of the agitator and is configured to rotate integrally with the agitator.

Figure 5:
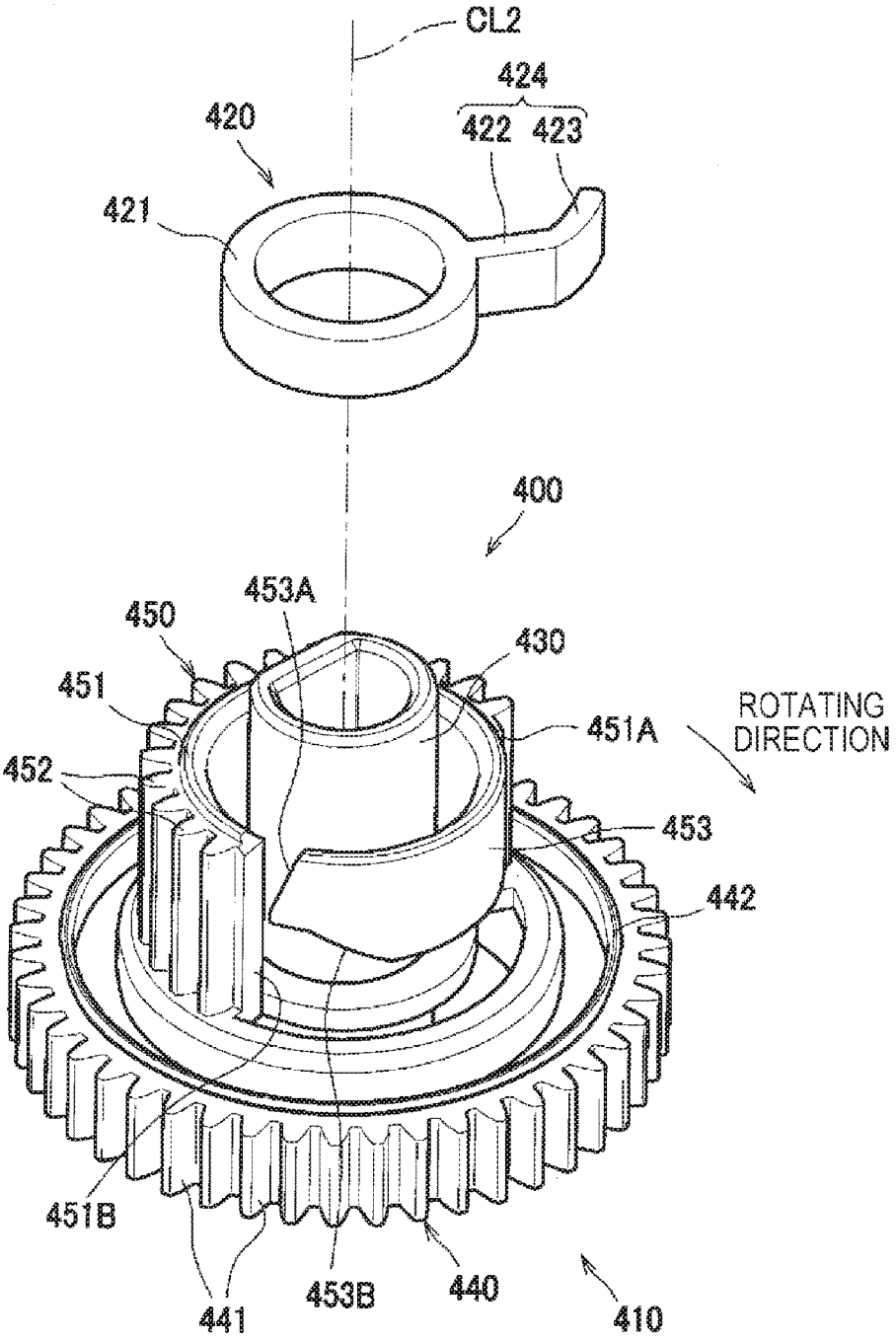
FIG. 5 is an exploded perspective view depicting the transmission gear.

As shown in FIG. 5, the first member 410 integrally has a rotating shaft part 430 extending in the axis direction, a large diameter gear part 440, and a small diameter gear part 450. The rotating shaft part 430 has a substantially cylinder shape centered on the second axis CL2 which is the rotating axis of the first member 410.

The large diameter gear part 440 is a gear adjacent to the small diameter gear part 450 in the axis direction and having a diameter larger than that of the small diameter gear part 450. The large diameter gear part 440 is arranged closer to the cartridge main body 100 than the small diameter gear part 450. That is, a distance between an outer surface of the cartridge main body 100 and the large diameter gear part 440 is shorter than a distance between the outer surface of the cartridge main body 100 and the small diameter gear part 450.

The large diameter gear part 440 has a circular plate part 442 having a circle shape centered on the second axis CL2 and a plurality of input/output gear tooth parts 441 formed over an entire circumference of an outer peripheral surface of the circular plate part 442. The input/output gear tooth parts 441 are meshed with the idle gear 140 and are input with the driving force from the idle gear 140. Also, the input/output gear tooth parts 441 are configured to face the second missing tooth part 351 of the detection gear 300 at the initial state and to mesh with the second gear tooth part 352 of the detection gear 300 at an appropriate timing after the driving force is input to the developing cartridge 8. In the meantime, gear diameters of the large diameter gear part 440 and the small diameter gear part 450 are defined as tooth tip circles thereof.

The small diameter gear part 450 integrally has an arc protrusion 451 and a plurality of output gear tooth parts 452 provided on an outer peripheral surface of the arc protrusion 451. The arc protrusion 451 protrudes upward from an upper end surface of the large diameter gear part 440 and extends in an arc shape about the second axis CL2.

The arc protrusion 451 has a first end portion 451A, which is a downstream end portion of the first member 410 with respect to the rotating direction, and a second end portion 451B, which is an upstream end portion with respect to the rotating direction, i.e., an opposite end portion to the first end portion 451A in the rotating direction. An opening that connects an inner side and an outer side of the arc protrusion 451 is formed between the first end portion 451A and the second end portion 351B of the arc protrusion 451. The opening is formed along the rotating direction. In other words, the opening is formed by the first end portion 451A, the second end portion 451B and the large diameter gear part 440. The arc protrusion 451 has an extension part 453 extending downstream of the rotating direction from the first end portion 451A toward the second end portion 451B. The extension part 453 has an arc shape centered on the second axis CL2, and is disposed with being spaced from the large diameter gear part 440 in the axis direction. Specifically, the extension part 453 is disposed at an opposite side to the large diameter gear part 440 with respect to the upper-lower direction of FIG. 2 with an engaged part 422 (which will be described later) of the second member 420 being interposed therebetween (refer to FIG. 2).

Also, the second end portion 451B and the extension part 453 of the arc protrusion 451 are disposed at an interval in the rotating direction. This spacing (a minimum distance between the second end portion 451B and the extension part 453) is smaller than a thickness of the engaged part 422 in the rotating direction.

An upper surface of a tip portion of the extension part 453 is configured as a first inclined surface 453A inclined toward a downstream side with respect to the rotating direction and toward the large diameter gear part 440-side, and a lower surface of the tip portion is configured as a second inclined surface 453B inclined from a lower end of the first inclined surface 453A toward an upstream side with respect to the rotating direction and toward the large diameter gear part 440-side. An upstream end edge of the second inclined surface 453B with respect to the rotating direction is arranged at a more upstream side with respect to the rotating direction than an upstream end edge of the first inclined surface 453A with respect to the rotating direction.

The output gear tooth parts 452 are gear teeth capable of meshing with the first gear tooth part 332 of the detection gear 300 and are disposed at positions spaced from the first gear tooth part 332 of the detection gear 300 at the initial state (which will be described later).

As shown in FIGS. 2 and 5, the second member 420 is disposed adjacent to the large diameter gear part 440 of the first member 410 in the axis direction and is configured to be rotatable about the second axis CL2. The second member 420 integrally has a cylindrical base part 421, which is an example of the support part, and a second trigger 424. The base part 421 has an inner peripheral surface, which is rotatably supported by an outer peripheral surface of the rotating shaft part 430 of the first member 410, and an outer peripheral surface disposed at a more inner side in the radial direction than the arc protrusion 451.

The second trigger 424 extends from the outer peripheral surface of the base part 421 in a direction intersecting with the axis direction and is arranged between the first end portion 451A and the second end portion 451B of the arc protrusion 451 in the rotating direction. The second trigger 424 has an engaged part 422, which is an example of the first part and the contact part, and a trigger part 423, which is an example of the second part.

The engaged part 422 extends from the outer peripheral surface of the base part 421 toward an outer side in the radial direction (toward a direction intersecting with the second axis CL2) and has a portion disposed at the same position as the arc protrusion 451 in the radial direction. The engaged part 422 protrudes radially outward from between the first end portion 451A and the second end portion 451B of the arc protrusion 451. At the initial state, the engaged part 422 is disposed at a more downstream side than the first end portion 451A of the arc protrusion 451 with respect to the rotating direction. In other words, at the initial state, the engaged part 422 is disposed at a more downstream side with respect to the rotating direction than a downstream surface of the arc protrusion 451 with respect to the rotating direction.

Figure 10A:
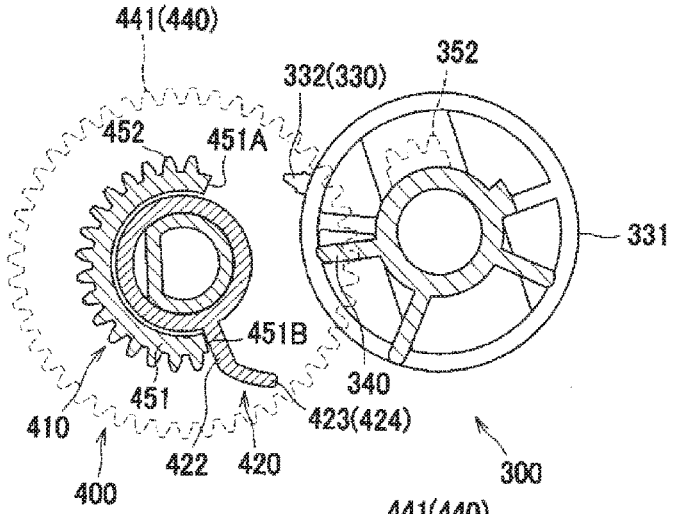
FIGS. 10A to 10C depict operations of respective gears from the initial state until the trigger part is engaged to a first trigger.
Figure 10B:
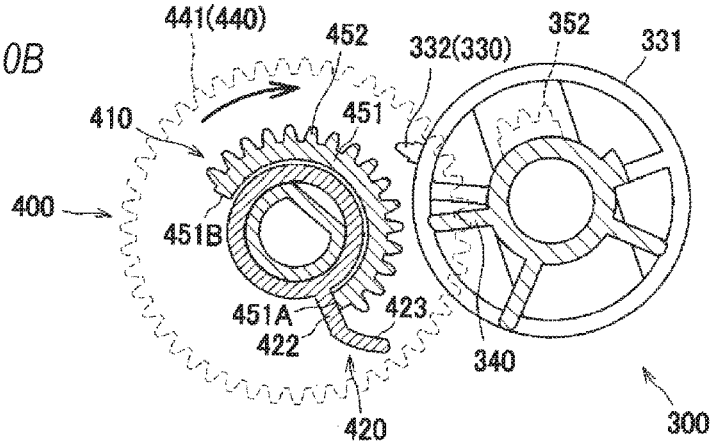
Figure 10C:
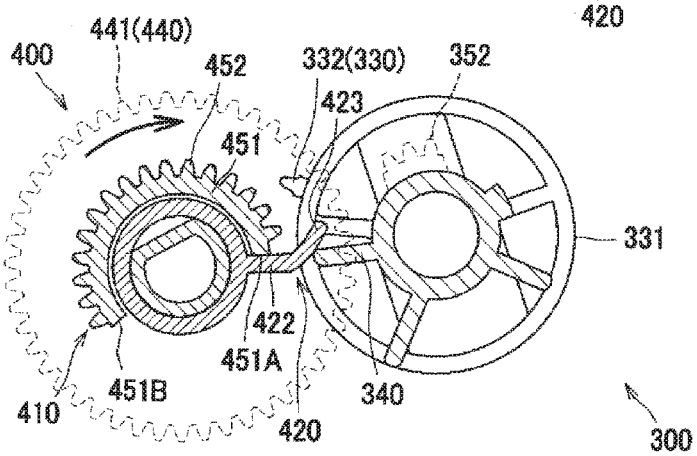

As shown in FIG. 10C, the trigger part 423 is a part that is to be engaged to the first trigger 340 and is to enable the first gear tooth part 332 to mesh with the output gear tooth parts 452 by rotating the detection gear 300, and extends from the engaged part 422 toward an upstream side with respect to the rotating direction and toward an outer side in the radial direction (toward a direction away from the second axis CL2). That is, the trigger part 423 extends with being inclined relative to the engaged part 422 in the rotating direction of the transmission gear 400. The trigger part 423 is disposed so that a rotating trajectory of the trigger part 423 overlaps with a rotating trajectory of the first trigger 340. At the initial state shown in FIG. 10A, the trigger part 423 is disposed at a position spaced downstream of the rotating direction of the second member 420 with respect to the first trigger 340.

The first member 410 and the second member 420 configured as described above are configured to be displaced to a state where the first member 410 rotates without engagement between the first end portion 451A of the arc protrusion 451 and the engaged part 422 and a state where the second member 420 and the first member 410 integrally rotate with the first end portion 451A of the arc protrusion 451 being engaged to the engaged part 422. In other words, the large diameter gear part 440 is configured to receive a driving force and rotate to thus move from a first position at which the large diameter gear part 440 can rotate relative to the second trigger 424 to a second position at which the large diameter gear part 440 rotates together with the second trigger 424.

At the first position, the large diameter gear part 440 and the small diameter gear part 450 are configured to rotate together. Also, at the first position, the second trigger 424 is configured to rotate relative to the large diameter gear part 440 and the small diameter gear part 450. Also, at the second position, the first end portion 451A of the arc protrusion 451 is configured to be engaged to the engaged part 422 of the second trigger 424 and the trigger part 423 of the second trigger 424 is configured to be engaged to the first trigger 340.

Figure 6:
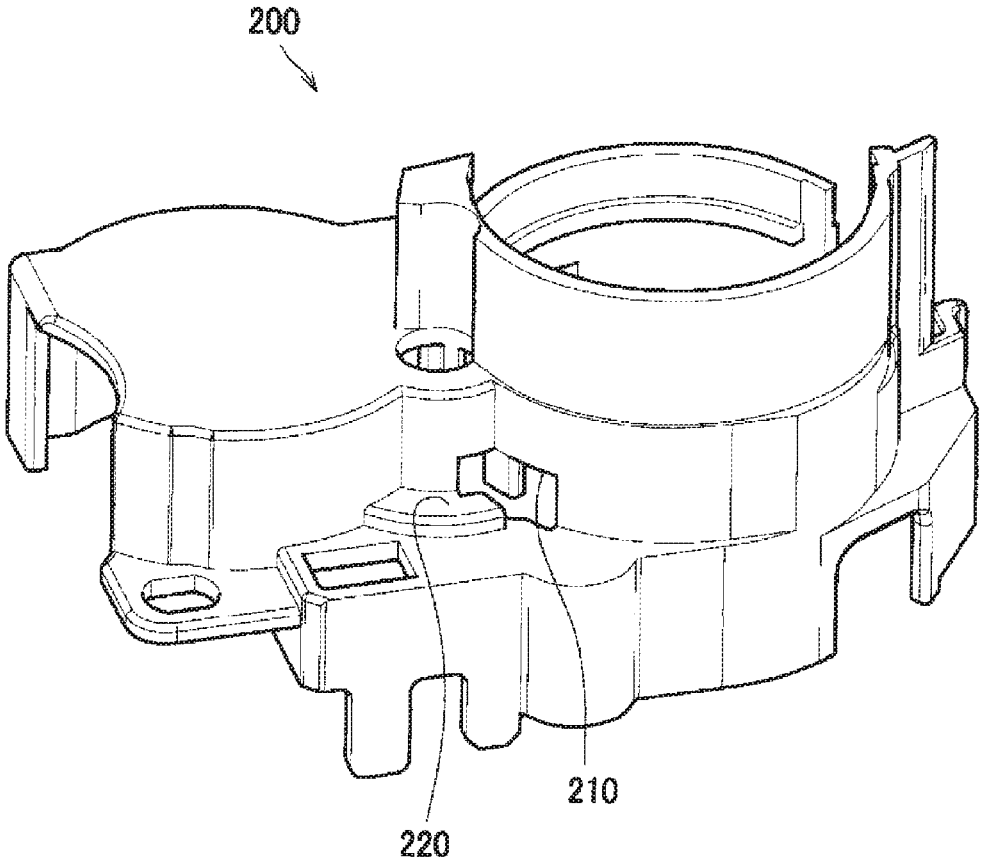
FIG. 6 is a perspective view depicting a gear cover.
Figure 7:
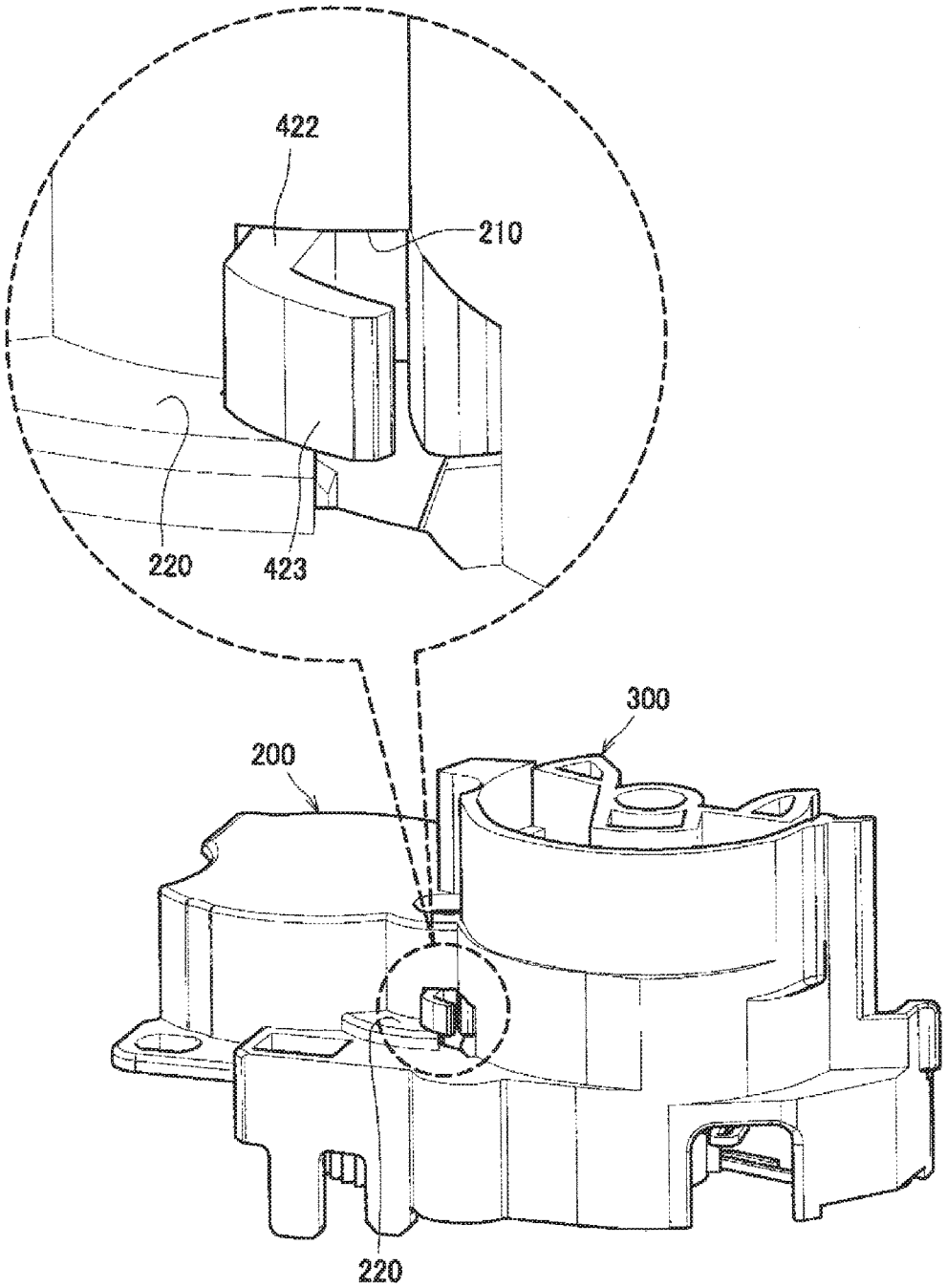
FIG. 7 is a perspective view depicting a state where a trigger part is supported by a support part of the gear cover upon product inspection.
Figure 8:
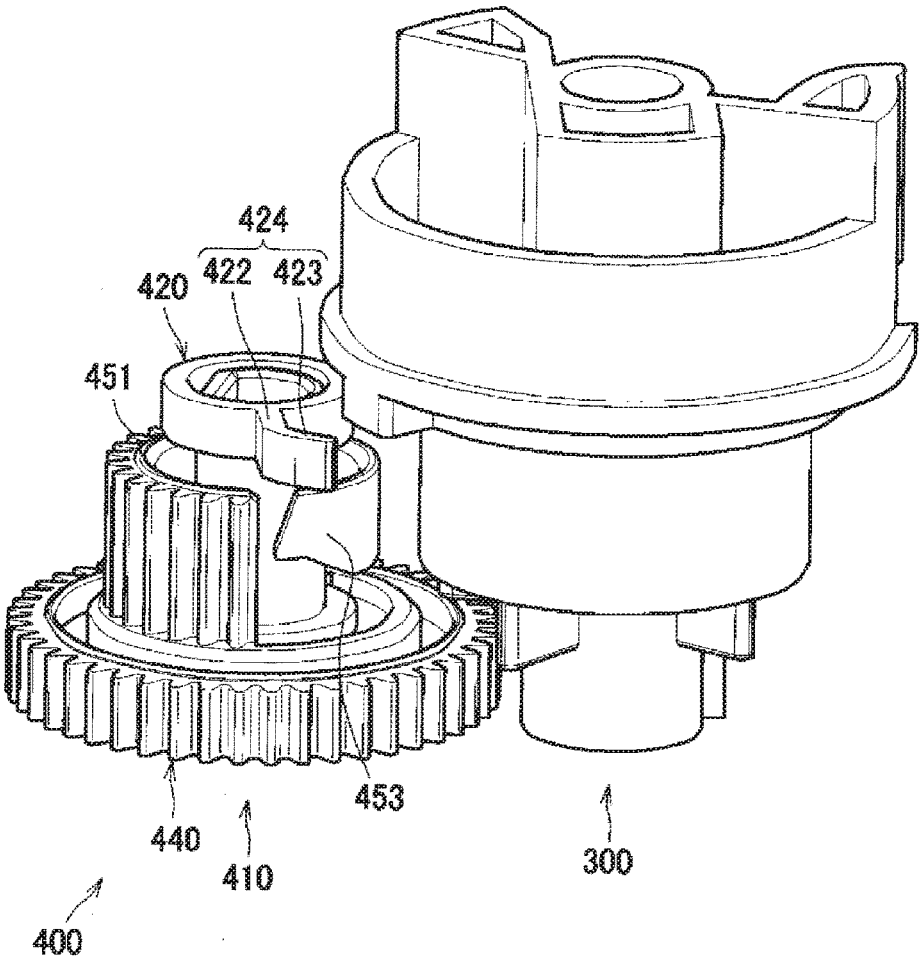
FIG. 8 is a perspective view depicting a relation between the trigger part supported by the support part of the gear cover and an arc-shaped protrusion.
Figure 9:
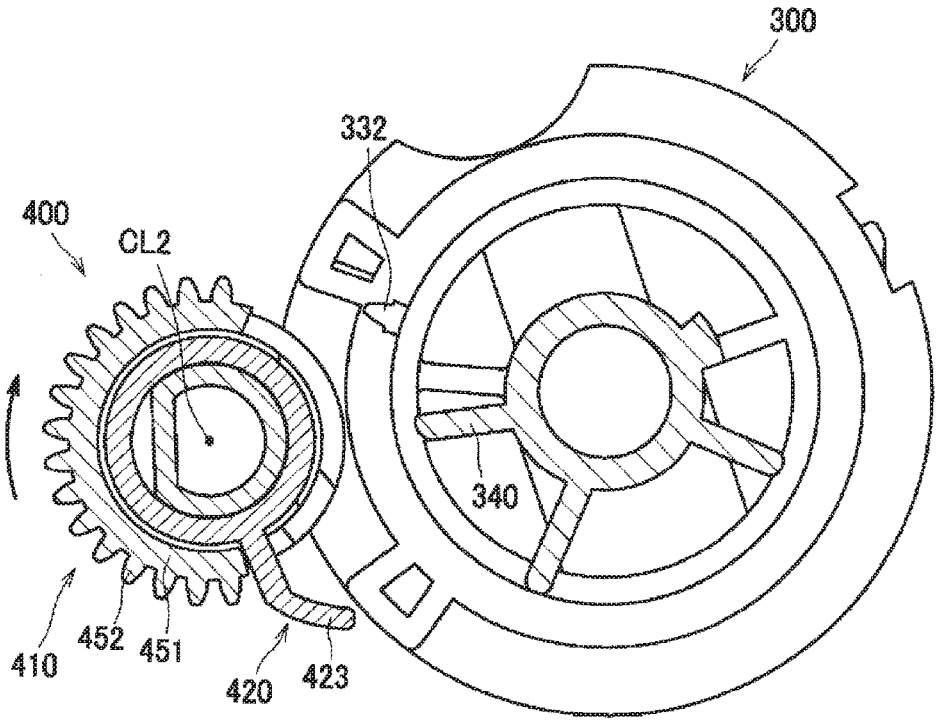
FIG. 9 depicts the transmission gear and the detection gear at an initial state.

As shown in FIGS. 6 and 7, the gear cover 200 is a cover configured to cover at least a part of the transmission gear 400, and has an opening 210 for allowing a part of the engaged part 422 and the trigger part 423 to protrude externally upon product inspection and a support surface 220 configured to support the trigger part 423 protruding from the opening 210. At a state where a surface of the trigger part 423 facing the large diameter gear part 440 is supported by the support surface 220, the second trigger 424 is arranged at an opposite side to the large diameter gear part 440 with respect to the extension part 453 in the axis direction, as shown in FIG. 8.

In the following, operations of the transmission gear 400 and the detection gear 300 are described.

As shown in FIG. 10A, at the initial state, i.e., at a state where the developing cartridge 8 is a brand-new product, the detection gear 300 is arranged at a third position shown in FIG. 10A. At the third position, the first trigger 340 is positioned on the rotating trajectory of the trigger part 423. Also, at the third position, the output gear tooth parts 452 of the first member 410 are spaced from the first gear tooth part 332 of the detection gear 300. Also, although not shown, at the third position, the input/output gear tooth parts 441 of the first member 410 are also spaced from the second gear tooth part 352 of the detection gear 300.

When the developing cartridge 8 is input with the driving force at the initial state, the first member 410 starts to rotate in a clockwise direction, as shown in FIG. 10B. At this time, when the second member 420 still remains at the initial position without sliding and rotating relative to the first member 410, the first member 410 rotates relative to the second member 420. Thereby, the first end portion 451A of the arc protrusion 451 comes close to and is contacted to the engaged part 422 of the second member 420.

In this way, when the first end portion 451A of the arc protrusion 451 is engaged to the engaged part 422, the first member 410 and the second member 420 start to rotate together. Thereby, the trigger part 423 of the second member 420 rotates in the clockwise direction and is engaged to the first trigger 340 of the detection gear 300, as shown in FIG. 10C.

Figure 11A:
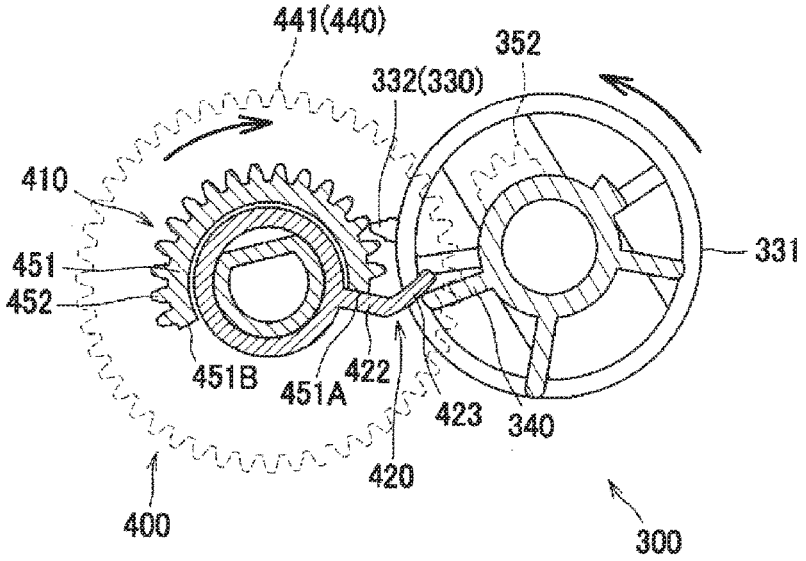
FIGS. 11A and 11B depict operations of the respective gears after the trigger part is engaged to the first trigger until the detection gear rotates to a final position.

When the trigger part 423 is engaged to the first trigger 340 in this way, the first end portion 451A of the arc-shaped protrusion presses downward the first trigger 340 via the engaged part 422 and the trigger part 423, as shown in FIG. 11A. Thereby, the detection gear 300 rotates by a predetermined amount and the first gear tooth part 332 of the detection gear 300 is engaged to the output gear tooth parts 452 of the first member 410, so that the detection gear 300 further rotates by a predetermined amount. In the meantime, a position at which the first gear tooth part 332 is engaged to the output gear tooth parts 452, as shown in FIG. 11A, corresponds to a fourth position.

Figure 11B:
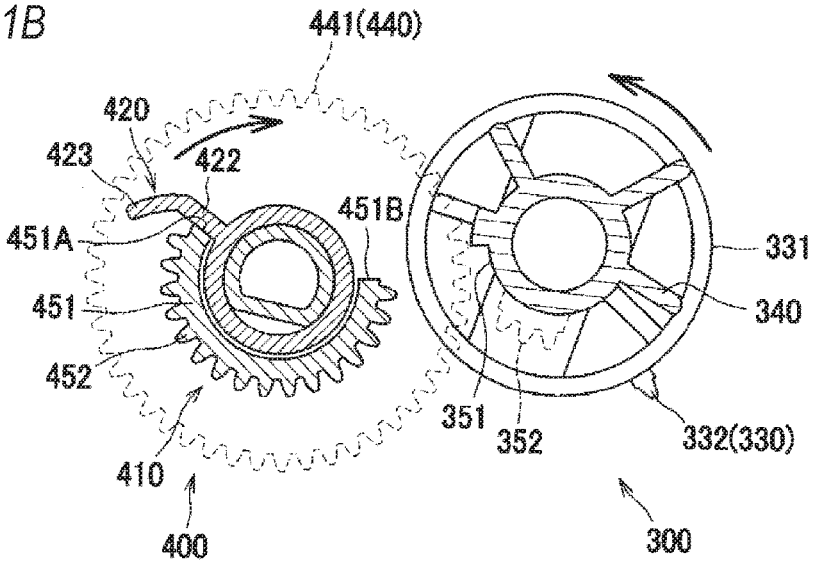

Thereafter, at a timing at which the output gear tooth parts 452 are about to be disengaged from the first gear tooth part 332, the large diameter gear part 440 of the first member 410 meshes with the second gear tooth part 352 of the detection gear 300, so that the detection gear 300 further rotates by a predetermined amount and reaches a final position shown in FIG. 11B. In the meantime, the final position, i.e., a position of the detection gear 300 when the first gear tooth part 332 is located outside the moving trajectory of the output gear tooth parts 452 corresponds to a fifth position. At the final position, the second missing tooth part 351 faces the plurality of input/output gear tooth parts 441 of the large diameter gear part 440.

In the meantime, when the first member 410 and the second member 420 rotate integrally by friction from the initial state of FIG. 10A, the trigger part 423 rotates in the clockwise direction with being close to the second end portion 451B of the arc protrusion 451. Then, when the trigger part 423 contacts the first trigger 340, the rotation of the trigger part 423 is stopped by the first trigger 340 and the rotation of the second member 420 is also stopped because the frictional force of the first member 410 and the second member 420 is less than a force of stopping the trigger part 423 by the first trigger 340. Thereafter, the first member 410 rotates relative to the stopped second member 420 in the clockwise direction, and the first end portion 451A of the arc protrusion 451 is engaged to the engaged part 422. Thereby, the first end portion 451A of the arc protrusion 451 presses downward the first trigger 340 via the engaged part 422 and the trigger part 423. Thereafter, accordingly, the transmission gear 400 and the detection gear 300 rotate in the same operations as the above-described operations.

The first detection protrusion 301 and the second detection protrusion 302 are used for enabling a control device (not shown) to determine whether the developing cartridge 8 is a brand-new product or not and to determine a specification thereof. In the following, the determinations on the brand-new product and specification in the illustrative embodiment are briefly described.

When the developing cartridge 8 is a brand-new product, the first detection protrusion 301 is disposed at a detection position (a rear position obliquely upward with respect to the first axis CL1) shown in FIG. 1A, and when the brand-new developing cartridge 8 is mounted to the main body of the image forming apparatus, the first detection protrusion 301 contacts the actuator 22 swingably provided to the main body of the image forming apparatus. When the first detection protrusion 301 contacts the actuator 22, the actuator 22 swings rearward and the swing is detected by an optical sensor (not shown). Thereby, the state where the developing cartridge 8 is mounted to the main body of the image forming apparatus is recognized by the control device (not shown).

In the meantime, the state where the actuator 22 swings rearward may be detected by a configuration where the actuator 22 located between a light emitting element and a light receiving element of the optical sensor swings rearward and deviates and the optical sensor becomes thus ON or a configuration where light is interrupted by the actuator 22 having swung rearward, i.e., the optical sensor becomes OFF. In the following descriptions, it is assumed that the rearward swing of the actuator 22 is detected as the optical sensor becomes ON.

Thereafter, when printing control starts and the developing cartridge 8 is input with the driving force, the first detection protrusion 301 and the second detection protrusion 302 rotate in a counterclockwise direction. When the first detection protrusion 301 separates from the actuator 22 resulting from the rotation, the actuator 22 returns to its original position (a position shown with a dashed-two dotted line) and the optical sensor becomes OFF.

Thereafter, when the second detection protrusion 302 reaches the detection position (rear position obliquely upward with respect to the first axis CL1), the actuator 22 is pushed rearward by the second detection protrusion 302 and the optical sensor becomes ON again. In this way, when the signal of the optical sensor changes in order of ON→OFF→ON after the developing cartridge 8 is input with the driving force, the control device determines that the mounted developing cartridge 8 is a brand-new product.

Also, when the second detection protrusion 302 is located at the detection position, the driving coupling between the detection gear 300 and the upstream gear (an upstream gear with respect to the transmission direction of the driving force) is decoupled, so that the position of the second detection protrusion 302 is kept at the detection position. For this reason, when the developing cartridge 8, which has been once used, is mounted to the main body of the image forming apparatus, the second detection protrusion 302 pushes rearward the actuator 22, so that the optical sensor becomes ON. Then, even when the printing control starts and the developing cartridge 8 is input with the driving force, the second detection protrusion 302 does not move from the detection position. Therefore, after the driving force is input to the developing cartridge 8, the signal of the optical sensor is still ON. In this case, the control device determines that the mounted developing cartridge 8 is a used product (has been used once or more).

Also, an interval (angle) from the upstream end of the first detection protrusion 301 with respect to the rotating direction to the downstream end of the second detection protrusion 302 with respect to the rotating direction is set in correspondence to the specification. Thereby, for example, when a time period from the ON state of the first detection protrusion 301 to the ON state of the second detection protrusion 302, i.e., an OFF time period is a first time period, the control device can determine that an amount of the toner accommodated in the cartridge main body 100 is a standard, and when the OFF time period is a second time period longer than the first time period, the control device can determine that the toner amount is larger than the standard type.

Specifically, for example, as shown in FIG. 4A, when the toner amount is the standard, the interval from the upstream end of the first detection protrusion 301 with respect to the rotating direction to the downstream end of the second detection protrusion 302 with respect to the rotating direction is set as a predetermined first interval.

Figure 4B:
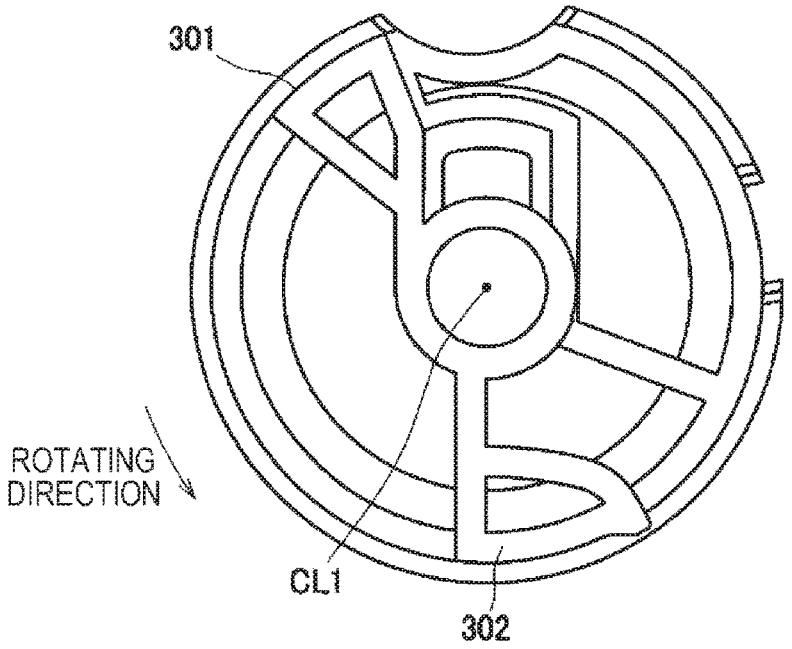
FIG. 4B depicts each detection protrusion of a large capacity type.

In contrast, as shown in FIG. 4B, when the toner amount is a large capacity type larger than the standard, the interval from the upstream end of the first detection protrusion 301 with respect to the rotating direction to the downstream end of the second detection protrusion 302 with respect to the rotating direction is set as a second interval larger than the first interval.

According to the above illustrative embodiment, it is possible to achieve following effects.

Since the timing at which the trigger part 423 provided to the second member 420 starts to move is delayed from the input of the driving force to the first member 410, it is possible to also delay the engaging timing of the trigger part 423 and the first trigger 340 and to delay the timing at which the first detection protrusion 301 starts to move. By delaying the timing at which the first detection protrusion 301 starts to move, it is possible to prolong the time for which the optical sensor becomes first ON upon the detection of the brand-new product. Therefore, it is possible to determine the first ON time more favorably, so that it is possible to determine the detection of the brand-new product more favorably.

Since the extension part 453 is disposed at the opposite side to the large diameter gear part 440 with the engaged part 422 of the second member 420 being interposed therebetween, it is possible to suppress the engaged part 422 from being disengaged from between the first end portion 451A and the second end portion 451B of the arc protrusion 451 by the extension part 453.

Since the interval between the second end portion 451B of the arc protrusion 451 and the extension part 453 is smaller than the length of the engaged part 422 in the rotating direction, it is possible to further suppress the engaged part 422 from being disengaged from between the first end portion 451A and the second end portion 451B of the arc protrusion 451.

Since it is possible to keep the second member 420 at a position spaced from the arc protrusion 451 by the support surface 220 of the gear cover 200, it is possible to suppress a situation where the trigger part 423 operates to move the detection gear 300 upon the inspection of the developing cartridge 8.

Since the trigger part 423 extends toward the outer side in the radial direction and toward the upstream side with respect to the rotating direction, it is possible to smoothly push the first trigger 340 by the trigger part 423.

In the meantime, the disclosure is not limited to the first illustrative embodiment and can be used in a variety of forms, as exemplified hereinafter. In the following descriptions, the members having substantially the same structures as the first illustrative embodiment are denoted with the same reference numerals and the descriptions thereof are omitted.

Figure 12:
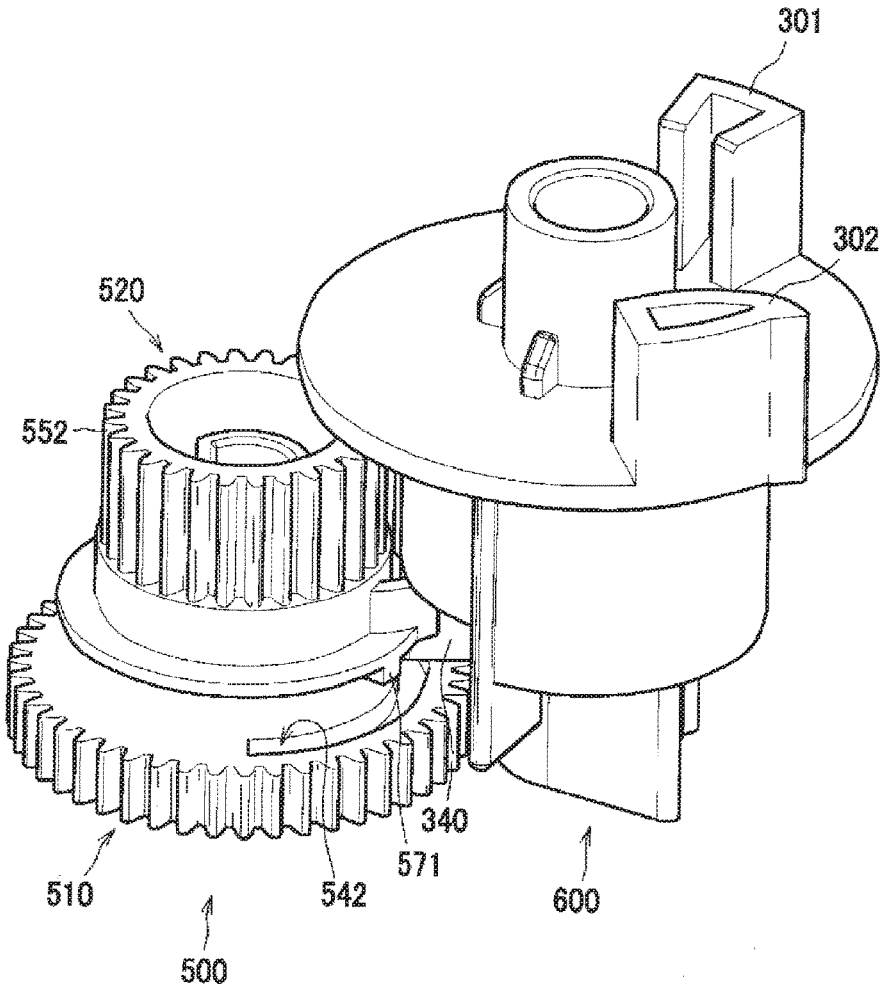
FIG. 12 is a perspective view depicting the transmission gear and the detection gear in accordance with a second illustrative embodiment.

In the first illustrative embodiment, the output gear tooth parts 452 are provided to the first member 410. However, the disclosure is not limited thereto. For example, as shown in FIG. 12, output gear tooth parts 552 may be provided to a second member 520. Specifically, in a second illustrative embodiment, a transmission gear 500 has a first member 510 and a second member 520, which are different from the first illustrative embodiment. Also, in the second illustrative embodiment, a detection gear 600 has the first detection protrusion 301, the second detection protrusion 302 and the first trigger 340, which have substantially the same structures as the first illustrative embodiment. In the meantime, the missing tooth part and the gear tooth part provided to the detection gear 600 are appropriately provided based on the same ideas as the first illustrative embodiment.

Figure 13:
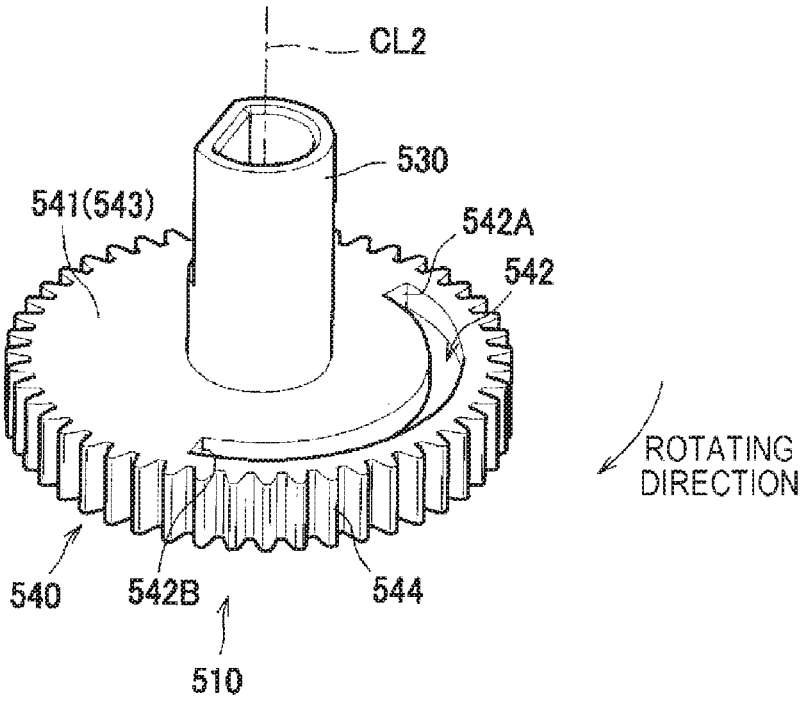
FIG. 13 is a perspective view depicting a first member in accordance with the second illustrative embodiment.

As shown in FIG. 13, the first member 510 integrally has a rotating shaft part 530 and a large diameter gear part 540, which have substantially the same structures as the first illustrative embodiment. The large diameter gear part 540 has a circular plate part 543 and a plurality of gear teeth 544 provided on an outer peripheral surface of the circular plate part 543. The plurality of gear teeth 544 is formed along the rotating direction. An end surface 541 of the circular plate part 543 facing the second member 520-side (an upper side in FIG. 13) is formed with an arc-shaped recess 542 centered on the second axis CL2. That is, the recess 542 is an example of the opening and is formed at a part in the rotating direction of the circular plate part 543. The recess 542 has a first surface 542A, which is an example of the first end portion, and a second surface 542B, which is an example of the second end portion. The first surface 542A is an upstream surface of the recess 542 with respect to the rotating direction. The second surface 542B is a downstream surface of the recess 542 with respect to the rotating direction.

Figure 14:
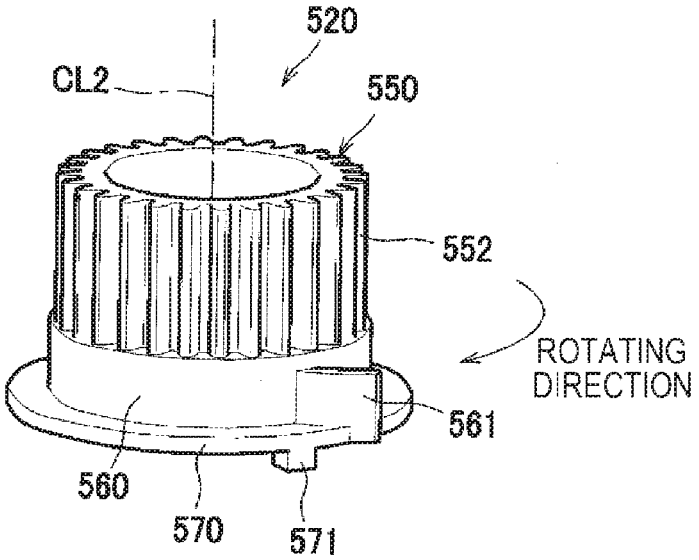
FIG. 14 is a perspective view depicting a second member in accordance with the second illustrative embodiment.

As shown in FIG. 14, the second member 520 integrally has a small diameter gear part 550 having the output gear tooth parts 552 formed on an outer peripheral surface thereof, a cylinder part 560 provided close to a lower side of the small diameter gear part 550, and a flange part 570 adjacent to a lower side of the cylinder part 560 and protruding more outward in the radial direction than the cylinder part 560. The cylinder part 560 is rotatably attached to the rotating shaft part 530 of the first member 510. That is, at the first position, the large diameter gear part 540 is configured to rotate relative to the small diameter gear part 550 and a second trigger 561 (which will be described later).

An outer peripheral surface of the cylinder part 560 is formed integrally with the second trigger 561 protruding outward in the radial direction. Thereby, at the first position, the small diameter gear part 550 and the second trigger 561 can rotate together. The second trigger 561 extends in a direction perpendicular to the axis direction so that it is inclined toward an upstream side with respect to the rotating direction of the transmission gear 500 as it is spaced from the second axis CL2.

A lower surface (a surface facing the first member 510) of the flange part 570 is provided with a convex portion 571 protruding downward in FIG. 14, which is an example of the second protrusion and the contact part. The convex portion 571 extends toward the circular plate part 560 in the axis direction and is configured to enter the arc-shaped recess 542 of the first member 510 with the second member 520 being attached to the first member 510. Meanwhile, in FIG. 12, for convenience sake, the second member 520 is shown with being spaced from the first member 510 in the axis direction so as to easily see the convex portion 571 and the recess 542.

Thereby, the upstream first surface 542A with respect to the rotating direction of the arc-shaped recess 542 can be engaged to the convex portion 571 in the rotating direction. That is, the first surface 542A corresponds to end portions in the rotating direction of the third engagement part and the recess. The first surface 542A is spaced from the convex portion 571 in the rotating direction of the transmission gear 500 at the first position and is engaged to the convex portion 571 at the second position.

Figure 15A:
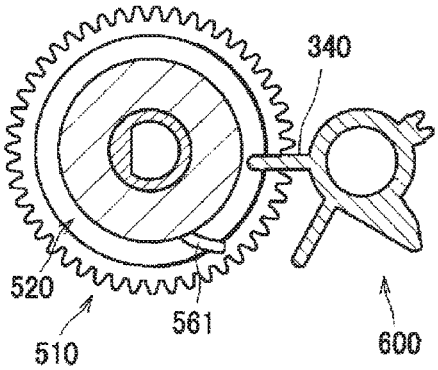
FIGS. 15A to 15F depict operations of the respective gears in accordance with the second illustrative embodiment.
Figure 15B:
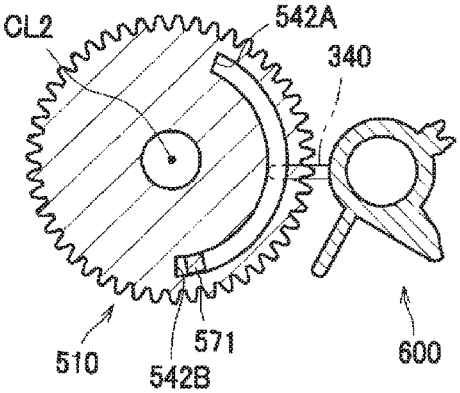
Figure 15C:
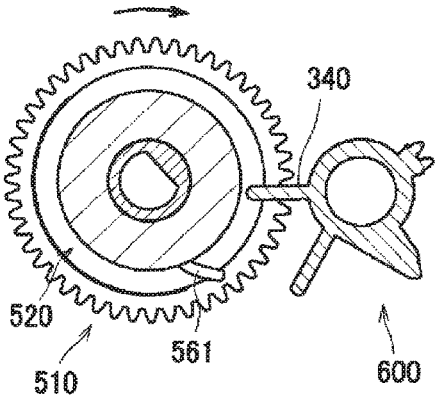
Figure 15D:
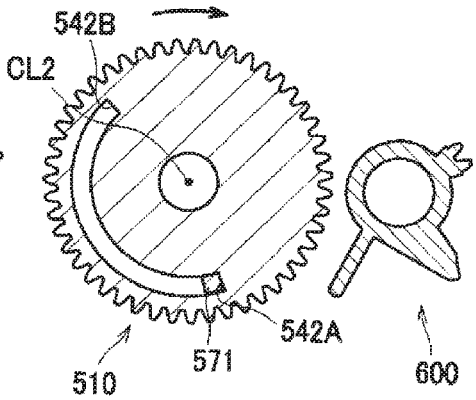

In the above configuration, when the first member 510 starts to rotate from the initial state shown in FIGS. 15A and 15B, the upstream first surface 542A of the recess 542 with respect to the rotating direction gradually comes close to the convex portion 571. Then, as shown in FIGS. 15C and 15D, when the first surface 542A is engaged to the convex portion 571, the first member 510 and the second member 520 rotate together and the second trigger 561 starts to rotate.

Figure 15E:
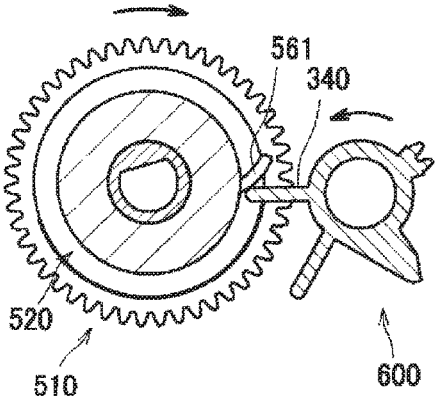
Figure 15F:
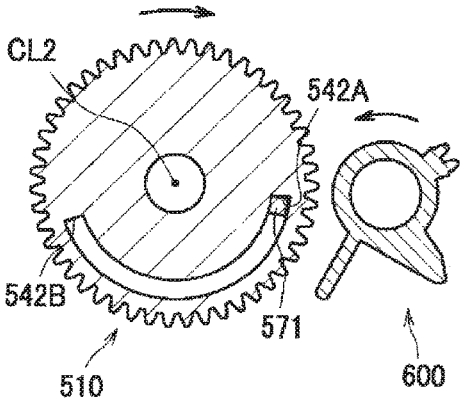

As shown in FIGS. 15E and 15F, when the second trigger 561 is engaged to the first trigger 340, the first trigger 340 is pushed downward, so that the detection gear 300 rotates by a predetermined amount. Thereafter, the detection gear 300 rotates in the substantially same operations as the first illustrative embodiment. Also in this configuration, since it is possible to delay the timing at which the second trigger 561 starts to move, it is possible to achieve the same effects as the first illustrative embodiment.

In the second illustrative embodiment, grease may be disposed in the recess 542. Thereby, it is possible to suppress the movement of the small diameter gear part 550 relative to the large diameter gear part 540 upon non-driving.

Figure 16:
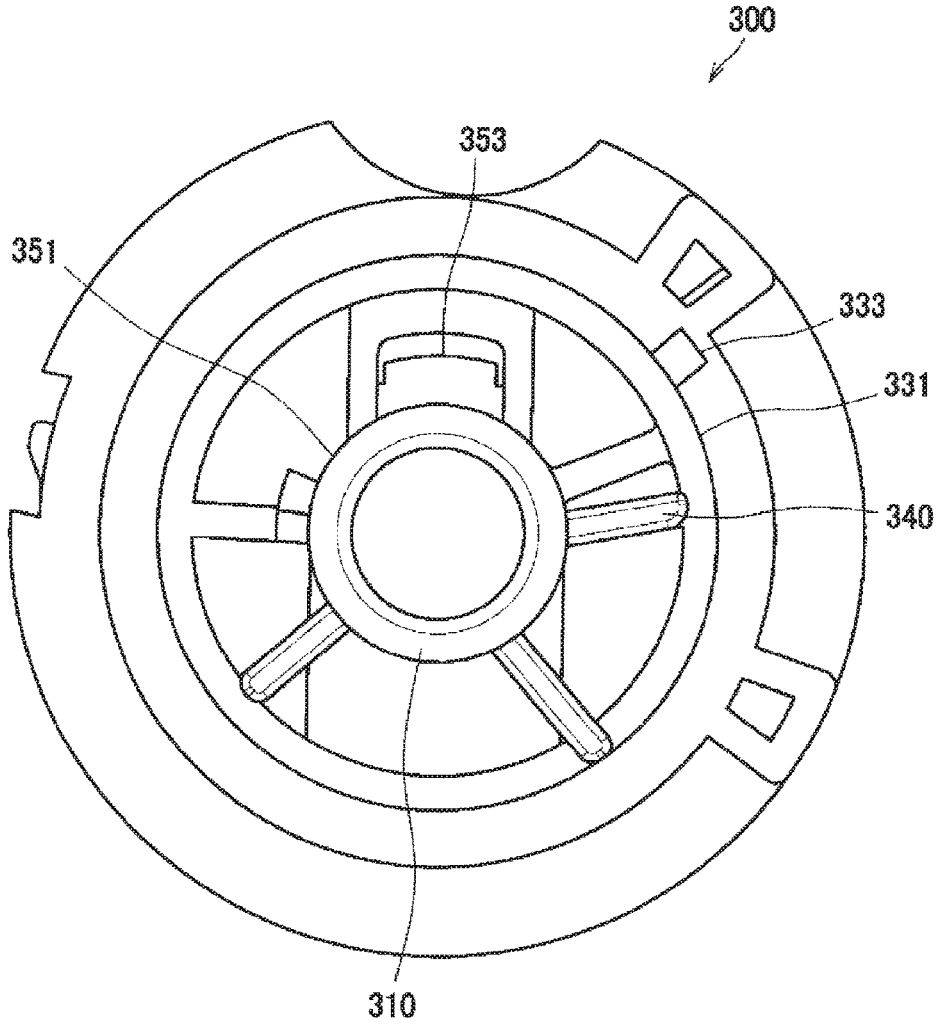
FIG. 16 depicts a modified embodiment of gear teeth.

In the above illustrative embodiments, the driving force is transmitted from the transmission gear to the detection gear by the gear teeth. However, the disclosure is not limited thereto. For example, a friction member such as rubber and sponge may be provided instead of the gear teeth. Specifically, for example, as shown in FIG. 16, instead of the first gear tooth part 332 of the detection gear 300, a first friction member 333 configured to be engaged to the small diameter gear part 450 by friction may be provided along a part of a periphery of the first missing tooth part 331, and instead of the second gear tooth part 352, a second friction member 353 configured to be engaged to the large diameter gear part 440 by friction may be provided along a part of a periphery of the second missing tooth part 351. Also, a friction member may be provided instead of the gear teeth of the transmission gear.

In the above illustrative embodiments, the detection gear is formed integrally with the detection protrusion. However, the disclosure is not limited thereto. For example, the detection protrusion may be a separate component from the detection gear and a resin film or a plate-shaped rubber material may be used, for example.

In the above illustrative embodiments, the two detection protrusions are used. However, the disclosure is not limited thereto. For example, the two detection protrusions of the above illustrative embodiments may be coupled in the rotating direction to configure an arc-shaped protrusion.

Figure 17:
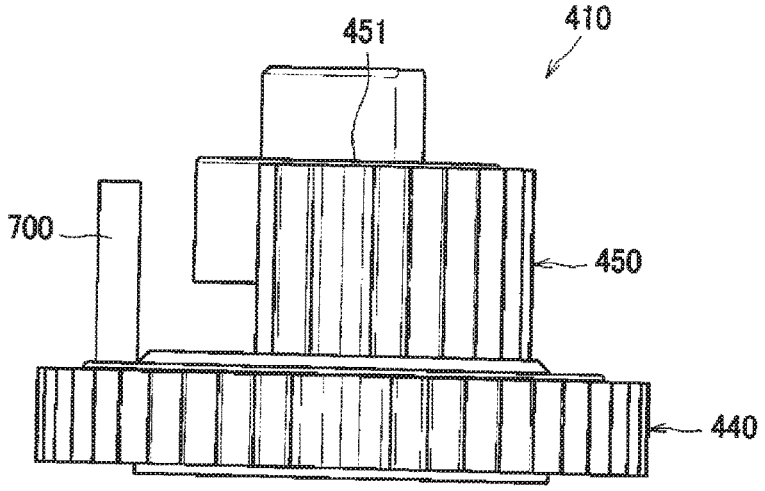
FIG. 17 depicts a first protrusion that is to be engaged to a second trigger.

In the first illustrative embodiment, the arc protrusion 451 having the gear teeth formed on the circumferential surface is engaged to the second trigger 424. However, the disclosure is not limited thereto. For example, as shown in FIG. 17, a first protrusion 700, which is a member or part different from the arc protrusion 451, may be provided to protrude from the large diameter gear part 440 in the axis direction and to be engaged to the second trigger 424. In this case, the second trigger 424 is spaced from the first protrusion 700 on the rotating trajectory of the second trigger 424 at the first position, and is engaged to the first protrusion 700 at the second position.

In the meantime, the first protrusion 700 may be provided at the first end portion 451A of the arc protrusion 451.

Figure 18:
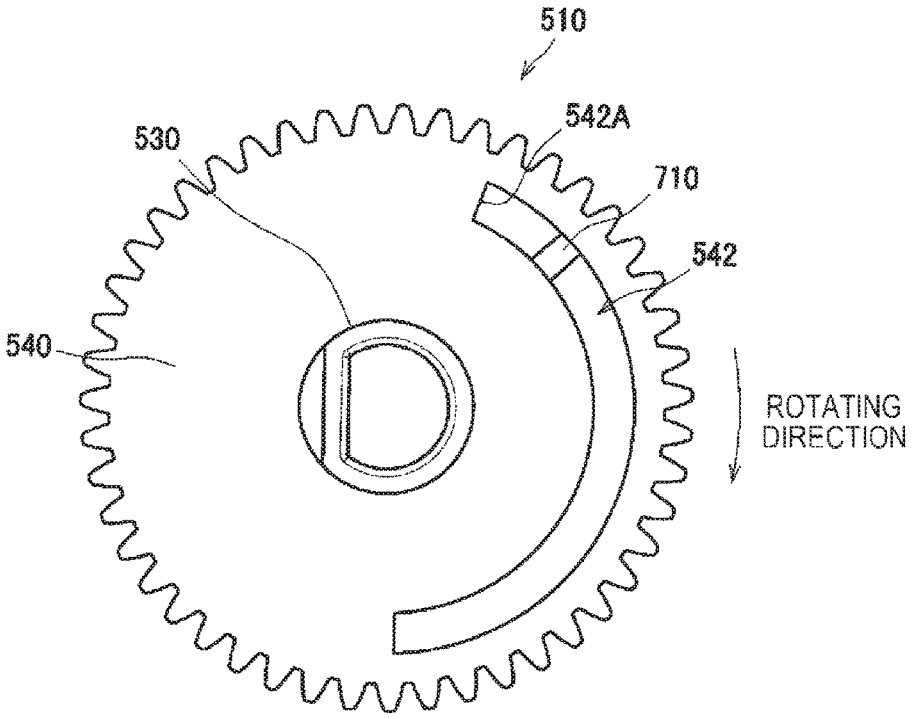
FIG. 18 depicts a modified embodiment of a third engagement part that is to be engaged to a convex portion of the second member.

In the second illustrative embodiment, the end portion of the recess 542 is engaged to the convex portion 571. However, the disclosure is not limited thereto. For example, as shown in FIG. 18, an engagement member 710 (an example of the third engagement part), which is a separate member from the large diameter gear part 540, may be provided in the recess 542, and the engagement member 710 may be configured to be engaged to the convex portion 571 (not shown). Meanwhile, in this case, the recess may be formed to have a circle shape, not the arc shape.

In the above illustrative embodiments, the detection gear 300 and the transmission gear 400 have been exemplified as the first gear and the second gear. However, the disclosure is not limited thereto. For example, the detection gear and any two adjacent gears of the plurality of gears configured to transmit the driving force to the detection gear may be configured as the first gear and the second gear.

In the above illustrative embodiments, the disclosure is applied to the laser printer 1. However, the disclosure is not limited thereto. For example, the disclosure may also be applied to other image forming apparatuses such as a copier, a complex machine and the like.

In the above illustrative embodiments, the disclosure is applied to the developing cartridge 8. However, the disclosure is not limited thereto. For example, when a developing device having the developing roller and a toner cartridge having a toner accommodation unit are separate components, the disclosure may be applied to the toner cartridge.

What is claimed is:

1. A developer cartridge comprising:

a first gear rotatable about a first axis extending in an axis direction, the first gear having:

a protruding part rotatable together with the first gear and protruding in the axis direction;

a first engagement part provided along a part of a circumferential surface of the first gear and formed along a rotating direction of the first gear; and a first trigger protruding from the circumferential surface of the first gear and being spaced from the first engagement part in the rotating direction; and a second gear rotatable about a second axis extending in the axis direction, the second gear having:

a small diameter gear part configured to be engaged to the first engagement part;

a large diameter gear part having a diameter larger than a diameter of the small diameter gear part and rotatable together with the small diameter gear part; and a second trigger configured to contact the first trigger and to rotate the first gear by rotating about the second axis, wherein the large diameter gear part is configured to receive a driving force and rotate to move from a first position at which the large diameter gear part can rotate relative to the second trigger to a second position at which the large diameter gear part rotates together with the second trigger, and wherein the second trigger is configured to rotate together with the large diameter gear part to contact the first trigger.

2. The developer cartridge according to claim 1, wherein the first engagement part is a gear tooth and is configured to mesh with the small diameter gear part.

3. The developer cartridge according to claim 2, wherein the large diameter gear part and the small diameter gear part are rotatable together at the first position, and wherein the second trigger is configured to be rotatable relative to the large diameter gear part and the small diameter gear part at the first position.

4. The developer cartridge according to claim 3, wherein the large diameter gear part has a circular plate part having a plurality of gear teeth on a circumferential surface thereof, wherein the second gear has a first protrusion protruding from the circular plate part along the axis direction and rotatable together with the circular plate part, and wherein the second trigger is spaced from the first protrusion on a rotating trajectory of the second trigger at the first position and is engaged to the first protrusion at the second position.

5. The developer cartridge according to claim 4, wherein the small diameter gear part has an arc protrusion having an arc shape centered on the second axis, protruding in the axis direction, extending in a rotating direction of the second gear, and having a plurality of gear teeth disposed on a circumferential surface thereof, wherein the arc protrusion has a first end portion in the rotating direction of the second gear and a second end portion opposite to the first end portion in the rotating direction of the second gear, wherein the second trigger is disposed between the first end portion and the second end portion in the rotating direction of the second gear, and wherein the first protrusion is provided at the first end portion.

6. The developer cartridge according to claim 5, wherein the arc protrusion has an extension part extending from the first end portion toward the second end portion, wherein the extension part is spaced from the large diameter gear part in the axis direction, and wherein the extension part is disposed at an opposite side to the large diameter gear part with the second trigger being interposed therebetween.

7. The developer cartridge according to claim 3, wherein the small diameter gear part has an arc protrusion having an arc shape centered on the second axis, protruding in the axis direction, and having a first end portion in a rotating direction of the second gear and a second end portion opposite to the first end portion in the rotating direction of the second gear, and wherein the second trigger is disposed between the first end portion and the second end portion in the rotating direction of the second gear.

8. The developer cartridge according to claim 1, wherein the small diameter gear part and the second trigger are configured to rotate together at the first position, and wherein the large diameter gear part is configured to rotate relative to the small diameter gear part and the second trigger at the first position.

9. The developer cartridge according to claim 8, wherein the large diameter gear part has:

a plurality of gear teeth formed along the rotating direction of the second gear, and a circular plate part having the plurality of gear teeth formed on a circumferential surface thereof, wherein the circular plate part has a recess extending along a rotating direction of the second gear, wherein the small diameter gear part has a second protrusion extending toward the circular plate part in the axis direction and disposed in the recess, and wherein the circular plate part has a third engagement part that is disposed in the recess, is spaced from the second protrusion in the rotating direction of the second gear at the first position, and is engaged to the second protrusion at the second position.

10. The developer cartridge according to claim 9, wherein the recess is formed at a part of the circular plate part in the rotating direction of the second gear, and wherein the third engagement part is an end portion of the recess in the rotating direction of the second gear.

11. The developer cartridge according to claim 1, further comprising:

a housing configured to accommodate therein developer; and an agitator having a rotating shaft and configured to stir the developer in the housing, wherein the rotating shaft supports the second gear.

12. The developer cartridge according to claim 1, wherein the first gear is configured to move from a third position at which the first trigger is located on a rotating trajectory of the second trigger to a fifth position at which the first engagement part is located outside of a moving trajectory of the small diameter gear part via a fourth position at which the first engagement part and the small diameter gear part are engaged to each other.

13. The developer cartridge according to claim 12, wherein the first gear has:

a gear tooth part having a plurality of gears formed on a circumferential surface thereof; and a missing tooth part having no gear tooth on a circumferential surface thereof, and wherein the missing tooth part is configured to face a plurality of gear teeth of the large diameter gear part at the fifth position.

14. The developer cartridge according to claim 12, wherein the protruding part has:

a first protruding part protruding in the axis direction; and a second protruding part spaced from the first protruding part in the rotating direction of the first gear and protruding in the axis direction, wherein the first protruding part is configured to contact a member of a main body of an image forming apparatus at the third position of the first gear, and wherein the second protruding part is configured to contact the member at the fifth position of the first gear.

15. A developer cartridge comprising:

a first gear rotatable about a first axis extending in an axis direction, the first gear having:

a protruding part rotatable together with the first gear and protruding in the axis direction;

a first engagement part provided along a part of a circumferential surface of the first gear and formed along a rotating direction of the first gear; and a first trigger protruding from the circumferential surface of the first gear and located with being spaced from the first engagement part in the rotating direction; and a second gear rotatable about a second axis extending in the axis direction and having an opening formed along a rotating direction, the second gear having:

a small diameter gear part configured to be engaged to the first engagement part;

a large diameter gear part having a diameter larger than the small diameter gear part and rotatable together with the small diameter gear part;

a second trigger configured to be engaged to the first trigger and to rotate the first gear by rotating about the second axis; and a contact part positioned in the opening and configured to rotate together with the second trigger, wherein an edge forming the opening has a first end portion in the rotating direction of the second gear and a second end portion opposite to the first end portion, and wherein the large diameter gear part is configured to rotate from a first position at which the first end portion and the contact part are spaced in the rotating direction and the large diameter gear part can rotate relative to the second trigger to a second position at which the first end portion and the contact part contact each other due to the rotation of the large diameter gear part and the large diameter gear part rotates together with the second trigger.

16. The developer cartridge according to claim 15, wherein the first engagement part is a gear tooth and is configured to mesh with the small diameter gear part.

17. The developer cartridge according to claim 16, wherein the large diameter gear part and the small diameter gear part are configured to rotate together at the first position, and wherein the second trigger is configured to rotate relative to the large diameter gear part and the small diameter gear part at the first position.

18. The developer cartridge according to claim 17, wherein the small diameter gear part has an arc protrusion having an arc shape centered on the second axis, protruding in the axis direction, and having the first end portion and the second end portion, and wherein the second trigger is disposed between the first end portion and the second end portion in the rotating direction of the second gear.

19. The developer cartridge according to claim 16, wherein the small diameter gear part and the second trigger are configured to rotate together at the first position, and wherein the large diameter gear part is configured to rotate relative to the small diameter gear part and the second trigger at the first position.

20. The developer cartridge according to claim 19, wherein the large diameter gear part has:

a plurality of gear teeth formed along the rotating direction of the second gear; and a circular plate part having the plurality of gear teeth formed on a circumferential surface thereof, wherein the circular plate part has a recess serving as the opening, the recess extending along the rotating direction of the second gear, wherein the small diameter gear part has the second trigger extending toward the circular plate part in the axis direction and disposed in the recess, and wherein the recess has the first end portion and the second end portion.

* * * * *